United States Patent [19]

Miram et al.

[11] Patent Number: 4,675,573

[45] Date of Patent: Jun. 23, 1987

[54] METHOD AND APPARATUS FOR QUICKLY HEATING A VACUUM TUBE CATHODE

[75] Inventors: George V. Miram, Atherton; Robert C. Treseder, Fremont, both of Calif.

[73] Assignee: Varian Associates, Inc., Palo Alto, Calif.

[21] Appl. No.: 768,883

[22] Filed: Aug. 23, 1985

[51] Int. Cl.[4] ..... H05B 39/00; H05B 41/14

[52] U.S. Cl. ..... 315/94; 313/337; 313/341; 313/347; 315/98; 315/116

[58] Field of Search ..... 313/337, 338, 347, 341; 315/94, 112, 116, 96, 98

[56] References Cited

U.S. PATENT DOCUMENTS

| | | | |
|---|---|---|---|
| 2,410,822 | 11/1946 | Kenyon | 313/347 |
| 2,912,616 | 11/1959 | Marchese et al. | 313/347 X |
| 3,119,041 | 1/1964 | Harris | 313/338 X |
| 3,406,305 | 10/1968 | Schiller et al. | 313/83 |
| 3,440,475 | 4/1969 | Schiller et al. | 313/337 |
| 3,521,113 | 7/1970 | Broers | 313/337 X |
| 3,558,966 | 1/1971 | Hill et al. | 313/346 |
| 3,671,792 | 6/1972 | Waltermire | 313/337 |
| 3,710,161 | 1/1973 | Beggs . | |
| 3,881,126 | 4/1975 | Boots et al. | 313/337 |
| 3,895,249 | 7/1975 | Andre et al. | 313/37 |
| 3,896,332 | 7/1975 | Heathcote | 315/39.51 |
| 3,947,715 | 3/1976 | Puhak | 313/270 |
| 3,958,146 | 5/1976 | Buescher et al. | 313/346 R |
| 3,982,153 | 9/1976 | Burdick et al. | 315/8 |
| 4,066,928 | 1/1978 | Van Besouw et al. | 313/341 |
| 4,115,720 | 9/1978 | Levine | 313/337 |
| 4,150,318 | 4/1979 | Kerstetter | 313/340 |
| 4,583,023 | 4/1986 | Friedman et al. | 313/340 |

*Primary Examiner*—Saxfield Chatmon

*Attorney, Agent, or Firm*—Stanley Z. Cole; Gerald M. Fisher; David Schnapf

[57] ABSTRACT

Disclosed are a method and apparatus for rapidly heating a thermionic vacuum tube cathode, thereby enabling the vacuum tube to be placed in useful operation shortly after the tube is switched on. Rapid heating of the cathode is achieved by passing current through the cathode, thereby directly heating it. Simultaneously, the cathode is also heated by an indirect radiant heater and by electron bombardment by electrons emitted from the heater. When the cathode reaches its operating temperature, the direct heating current and the electron bombardment are stopped and the cathode is maintained at its operating temperature by the indirect heater alone. Cathode warm-up times of less than 1 second may be attained using this invention.

28 Claims, 9 Drawing Figures

METHOD AND APPARATUS FOR QUICKLY HEATING A VACUUM TUBE CATHODE

BACKGROUND OF THE INVENTION

1. Field of the Invention

The present invention is directed to a method and apparatus for quickly heating a thermionic vacuum tube cathode thereby allowing use of the tube soon after it is switched on.

2. Description of the Prior Art

Most vacuum tubes use thermionic cathodes; i.e., cathodes comprising material which emits electrons when heated, thereby providing the electron beam used in the tube. Such tubes cannot be placed in useful operation until their cathodes are heated to a temperature sufficient to provide the necessary stream of electrons. It has long been an objective of manufacturers and users of vacuum tubes to minimize the length of time that it takes the cathode to heat up to its operating temperature.

Various methods and structures have been devised to meet the desire for a capability to quickly heat the cathode assembly used in vacuum tubes. One universally applied approach is to minimize the mass of the cathode structure. It is elementary that for a given thermal energy input, a cathode structure of lower mass will reach a given operating temperature faster than a more massive cathode structure of the same material. Reducing mass as a means to improve heat-up time is limited by the need for the cathode to contain a sufficient amount of thermoionic material to provide the desired electron current, along with the need for structural support which adds to the thermal mass of the cathode assembly.

Directly heated cathodes are heated by passing electrical current directly through the resistive body of the cathode, normally a wire. In such cathodes the rate of heating can be increased by initially increasing the current through the cathode beyond that necessary to maintain the cathode at its operating temperature. This approach is limited by the ability of the cathode to withstand higher current levels.

Indirectly heated cathodes have a separate heater element or filament placed in close proximity to the cathode, but electrically isolated therefrom. Heat is transferred from the heater to the cathode by radiation across a vacuum or by conduction through a thermally conductive, electrically insulative material in good thermal contact with both the heater and the cathode.

A heater need not be as massive as a cathode and therefore can be made to heat more rapidly. The rate at which heat is transferred from the heater to the cathode may be maximized by selecting materials of high emissivity and/or high thermal conductivity. Increasing the current through the heater during cathode warm-up, beyond the normal operating current, will cause the heater to heat more rapidly and thereby decrease the time needed to place the tube in operation. Again, this is limited by the ability of the heater materials to withstand the higher current and temperature, and the deleterious effects these increased factors have on the heater's useful life.

Indirect heating by conduction requires a very good thermal contact between the filament and cathode. The need to dispose electrically insulating material between the filament and the cathode adds to the thermal mass of the combined structure. Problems can arise due to thermal stress and cracking, resulting in degraded performance after a few warm-up cycles.

Another, somewhat different, approach allowing a vacuum tube to be placed in operation quickly is to maintain the cathode at or near its operating temperature at all times. While the related circuitry is off, the cathode heater is supplied with current to keep the cathode ready for operation. This approach permits almost instantaneous use of the tube when desired since there is no warm-up cycle. Nonetheless, maintaining the cathode in a heated state is costly in terms of energy usage, may be undesirable due to the fact that the apparatus is in an alive and heated state at all times, and will shorten the useful life of the tube.

Cathodes using impregnated tungsten or thoriated tungsten emitters are used in many high power microwave and power grid tube applications since they are capable of supplying the necessary high current densities over relatively long time periods. Such cathodes typically operate at higher temperatures than the more common oxide cathodes used in devices such as television cathode ray tubes. Therefore, in tubes using impregnated tungsten or thoriated tungsten cathodes, warm-up time can be a more significant problem due to the need to bring the cathode to a much higher temperature. Nonetheless, many of the applications for such tubes are very time-critical and the need for a very short warm-up cycle essential.

Accordingly, it is an object of this invention to provide a method and apparatus for quickly heating a vacuum tube cathode so that the tube may be placed in useful operation shortly after it is switched on.

It is a further object of this invention to overcome the limitations of prior art means for quickly heating a vacuum tube cathode, thereby decreasing the delay before a vacuum tube can be used.

Yet another object of this invention is to provide a quick-start method and apparatus useful with impregnated tungsten and thoriated tungsten cathodes.

Still another object of this invention is to provide a quick-start cathode assembly which allows the tube to be placed in use less than one second from the time it is switched on.

SUMMARY OF THE INVENTION

The foregoing objects are realized in the present invention by novel combinations of techniques, and of structures, for cathode heating. During the warm-up cycle, starting immediately after the tube is switched on, the cathode is directly heated by passing current through its resistive body. The current level may be maximized to provide maximum heating by this mode consistent with materials limitations. The cathode is simultaneously heated by an indirect radiant heater which may have a coating of electron emissive material. The indirect heater is used both during the warm-up of the cathode and during tube operation. During the cathode warm-up cycle the heater current may be increased beyond the normal operating level thereby increasing the rate at which it heats. The heater is of low mass and is designed to heat more quickly than the cathode. Finally, a voltage is applied between the heater and the cathode during the warm-up cycle so that electrons are emitted from the heater and bombard the cathode, providing an additional source of thermal energy to heat the cathode. When the cathode reaches its operating temperature the direct heating current through the cathode and the electron bombardment are switched off. Thereafter, the heater is used alone to maintain the cathode at its normal operating temperature.

DETAILED DESCRIPTION OF THE INVENTION

Figure 1:
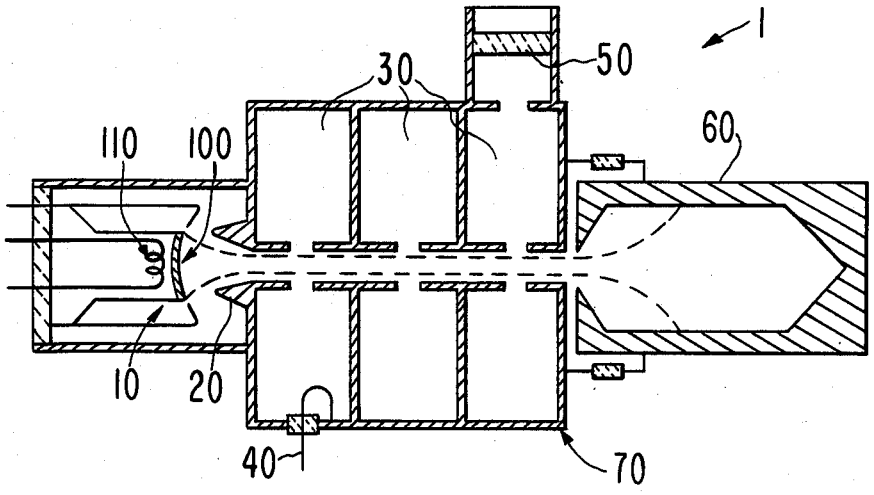
FIG. 1 is a schematic cross-section of a klystron embodying the present invention.

FIG. 1 shows a schematic view of a klystron 1 having a cathode assembly 10 embodying the present invention. The present invention is particularly well suited for use in microwave tubes, such as klystrons and travelling wave tubes, in applications which require quick start capability. Such tubes require cathodes capable of producing high current densitities and thus are usually made of impregnated tungsten or thoriated tungsten. In addition to the cathode assembly 10, the major elements of the klystron 1 are anode 20, cavities 30, input coupler 40, output window 50 and a collector 60, all of which are maintained in a vacuum envelope 70.

While FIG. 1 shows the present invention incorporated into a klystron, it is clear that the present invention may be incorporated into any other kind of vacuum tube using a thermionic emitter requiring a warm-up cycle, including tubes using conventional barium oxide cathodes. Although FIG. 1 shows a non-gridded tube, it will be clear to those skilled in the art that the present invention is equally applicable to gridded vacuum tubes. Such a gridded tube is shown schematically in FIG. 6.

Figure 2:
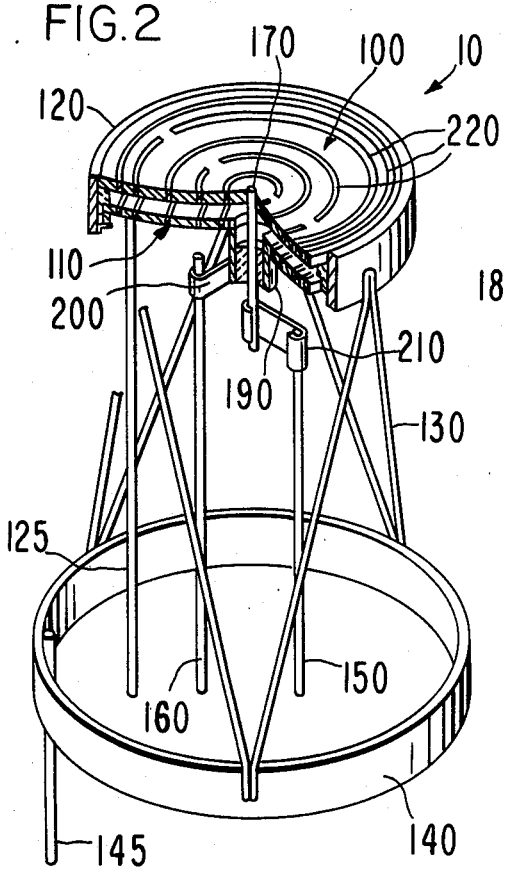
FIG. 2 is a partially cut-away view of a cathode/-heater assembly according to one embodiment of the present invention.
Figure 3:
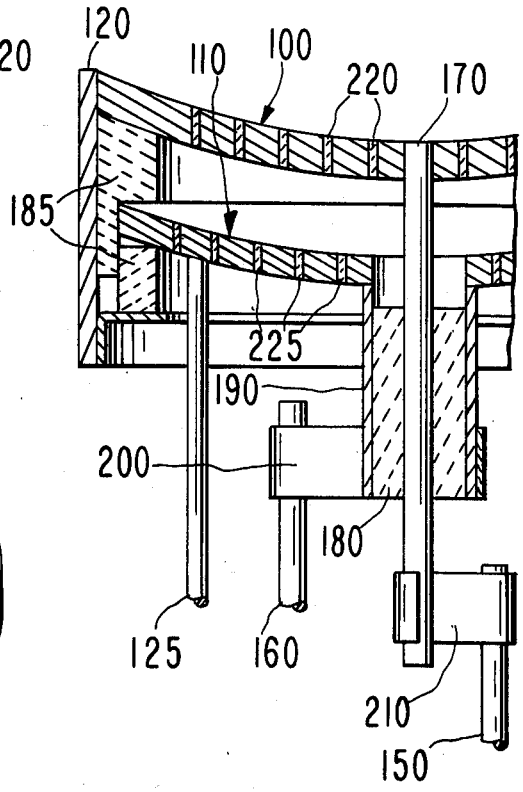
FIG. 3 is partial cross-section of a portion of the cathode/heater assembly.

FIGS. 2 and 3 show cathode assembly 10 in detail. A cathode button 100 and a heater 110 are maintained in close proximity with their surfaces held in parallel by a first support ring 120. The cathode button 100 is generally circular in shape with a concave emitting surface. It is understood that the concavity of the cathode is determined relative to the electron beam it produces. Insulating members 185 serve to electrically isolate the heater 110 from the conductive support ring 120. A plurality of legs 130 are connected to said support ring 120. The legs 130 are attached at their opposite ends to a second support ring 140 which is mounted by conventional means inside the tube 1.

Electrical leads 150 and 160 provide means for applying voltages from a power supply (not shown) to the center of cathode button 100 and heater 110 respectively. An aperture located in the center of heater 110 allows a wire 170 to pass through the heater 110 and to make electrical contact the center of the cathode button 100. Insulating member 180 separates said wire 170 from cylinder 190. Electrically conductive cylinder 190 makes electrical contact with the periphery of the central aperture of the heater 110. Leads 150 and 160 are connected to wire 170 and cylinder 190 by interconnecting members 200 and 210 respectively. It is necessary to electrically isolate the heater 110 from the cathode 100 so that a high voltage can be applied between them to cause electron bombardment.

Figure 4:
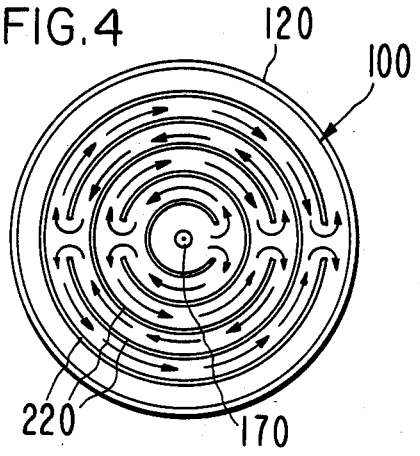
FIG. 4 is a top view of the directly heated cathode button with flow lines showing the path of the electrical current when the cathode is being directly heated.

FIG. 4 is a top view of the cathode button 100 with flow lines showing electrical current flowing through the cathode while it is operating in the direct heating mode. Two serpentine paths for electrical current are created between the center and the perimeter of the cathode button 100. After flowing through the cathode, current is returned to the power supply via support ring 120, legs 130, second support ring 140 and lead 145.

Direct cathode heating would be very inefficient and uneven if the current could simply travel radially between center wire 170 and support ring 120. Accordingly, the current paths are substantially lengthened by incorporating insulating pieces 220 into the cathode button 100. These paths also ensure that current flows evenly through the cathode body. Various patterns can be designed for disposing thermally conductive insulating pieces 220 in the cathode button 100 other than the pattern shown in FIG. 4. It is readily apparent that a lengthy serpentine path can be created using only a single insulating member in the shape of a spiral.

The same structure depicted in FIG. 4 is used for passing current through the heater 110, except that current enters the heater through cylinder 120 connected to the perimeter of the central heater aperture and returns to the power supply via lead 125. One advantage of the pattern shown for insulating pieces 225 used in the heater, lies in the fact that the current repeatedly reverses direction. This tends to minimize the magnetic perturbation caused by the current flow in the heater 110. Since the current flow through the cathode 100 is switched off before the tube is placed in operation, its magnetic perturbation is not a consideration.

Cathode button 100 may be made of any traditional thermionic emitter. For microwave tube applications, impregnated tungsten has proven to be especially useful. The design and construction of impregnated tungsten cathodes are well known in the art. Thermally-conductive insulating pieces 220 may be made of anisotropic pyrolytic boron nitride (APBN).

In the instant invention, the heater 110 may also comprise thermionic material. Since the heater 110 is typically operated at a higher temperature than the cathode button 100, the thermionic emissive material incorporated into the heater 110 should be able to withstand this higher temperature. Accordingly, thoriated tungsten is useful as a heater material. Alternately, the heater may be made of a traditional material such as tungsten or a tungsten rhenium alloy. Such material, although not an efficient thermionic emitter, will emit a sufficient number of electrons to provide cathode bombardment as described below.

As noted above, heater 110 contains insulating pieces 225 such as the insulating pieces 220 in FIG. 4. Again, APBN is suitable for this purpose.

Figure 5A:
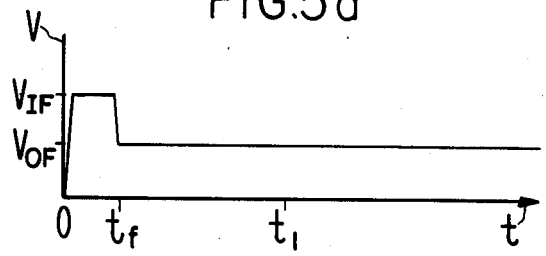
FIGS. 5*a* through 5*d* are graphs depicting the voltages applied to various tube elements during the warm-up and operating cylces of a vacuum tube embodying the present invention.
Figure 5B:
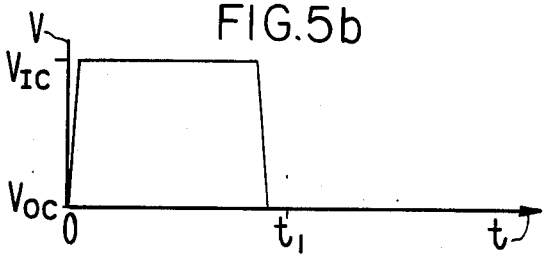
Figure 5C:
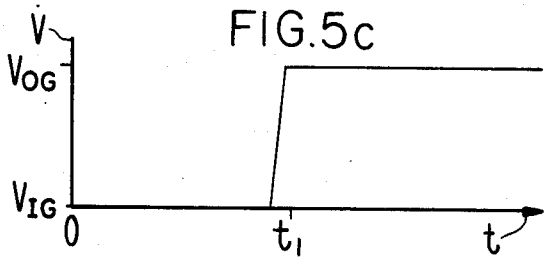

FIGS. 5*a* through 5*d* display the voltages applied to the various tube elements during the warm-up and operating phases of tube utilization. In each Figure the vertical axis corresponds to the applied voltage and the horizontal axis applies to time. (The voltages shown are relative and are not drawn to scale. For example, $V_{OG}$ in FIG. 5*c* is not likely to to be the same value as $V_{IC}$ in FIG. 5*b*.) At t=0, the tube is switched on and the warm-up cycle begins. At $t_1$ the cathode has reached its operating temperature and the tube is placed in operation. The present invention enables the construction of tubes having warm-up cycles where $t_1$ is less than one second.

FIG. 5*a* represents the voltage applied to the center of the heater measured in respect to the voltage at lead 125 at the edge of the heater. During the first part of the warm-up cycle, a heater voltage $V_{IF}$ is applied across the heater. $V_{IF}$ is much larger than heater operating voltage $V_{OF}$, and may be in excess of twice $V_{OF}$. However, it is ultimately limited by the ability of the heater material to withstand higher current and temperature, and may be further constrained by power supply limitations depending on overall system design.

In the present invention, the heater must reach its operating temperature much more rapidly than the cathode since it supplies electrons for bombarding the cathode. The heater will not emit electrons until it has reached a sufficiently elevated temperature. At $t_f$, when the heater has reached its operating temperature of approximately 1700°-2000° C. for thoriated tungsten and tungsten rhenium, the voltage is reduced to $V_{OF}$. Thus, FIG. 5*a* shows the voltage reduction to $V_{OF}$ occurring well before $t_1$. Since the heater does not have to supply the high current density of the cathode, it may have much less mass, thereby enabling it to more quickly reach its operating temperature.

FIG. 5*b* shows the voltage $V_{IC}$ applied to the center of the cathode button 100 via lead 150. $V_{IC}$ is measured with respect to the voltage at the peripheral ring 120. Both peripheral ring 120, which provides the return path for current flowing through the cathode, and the center of the cathode are maintained at a positive potential with respect to the heater. Thus, the entire cathode is positive with respect to the heater. The voltage difference between the two may be conveniently referred to as $V_B$—the bombarder voltage.

During the beginning of the warm-up cycle, no electrons are emitted from the heater; therefore, there is no electron bombardment of the cathode. After heating rapidly the heater begins to emit electrons which are then attracted to the cathode. A large proportion of the thermal energy necessary to heat the cathode may be imparted by electron bombardment. The potential between the heater and the cathode may ($V_B$) be maximized such that the electrons from the heater reach a very high velocity before striking the cathode button. In practice $V_B$ is much larger than either $V_{IC}$ or $V_{IF}$. However, $V_B$ cannot be so high as to cause the electron flow to damage the cathode button.

Just before the tube is to be placed in operation at $t_1$, the voltage across the cathode is switched off and the entire cathode is maintained at a potential $V_{OC}$ the same as or negative in respect to the heater (i.e., $V_B \leqq 0$), thereby stopping both the direct heating and the electron bombardment of the cathode. Thus, $V_B$ follows the same pattern as depicted in FIG. 5*b* for the direct heating voltage.

FIG. 5*c* represents the voltage applied to the grid of gridded vacuum tubes employing the present invention. During the warm-up cycle, a negative voltge $V_{IG}$ relative to the cathode is applied to the grid, thereby preventing emission of electrons from the cathode button 100. After $t_1$ the grid operating voltage, $V_{OG}$ is applied to the grid. The grid voltage can either be pulsed or maintained at a positive potential (as shown) or a negative potential in respect to the cathode.

Figure 5D:
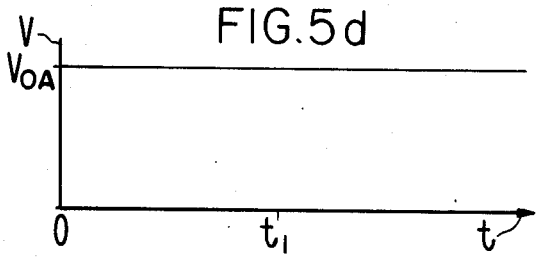

Finally, FIG. 5*d* shows the beam voltage $V_{OA}$ for a gridded tube, i.e., the voltage applied to the anode of the tube. Since the negative grid voltage applied during warm-up prevents a beam from forming, the normal beam voltage $V_{OA}$ may be applied at the beginning of the warm-up cycle eliminating the need for switching means. For non-gridded tubes, the beam voltage may conform to FIG. 5*c*, rather than 5*d*.

Figure 6:
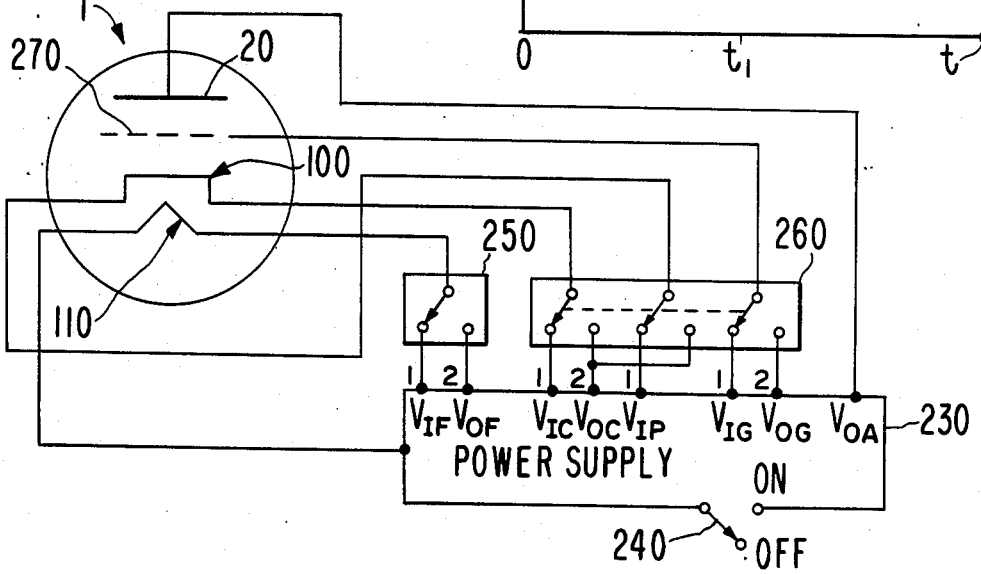
FIG. 6 is a schematic diagram of a gridded vacuum tube and an embodiment of switching circuits used in practicing the present invention.

FIG. 6 is a schematic diagram of one embodiment of the basic electrical circuitry for practicing the present invention with a gridded tube. Vacuum tube 1 comprises an anode 20, a grid 270, a cathode 100 and a heater 110. A power supply 230 is turned on and off by switch 240. Power supply 230 is adapted to provide a variety of voltages to the different tube elements. Switches 250 and 260 are disposed between the power supply and the tube. Switch 250 is a single pole, double throw switch controlling the voltage to the heater. Initially, at t=0 when the tube power supply is switched on, switch 250 is in position 1 as shown in FIG. 6. This applies $V_{IF}$ to the heater. At $t=t_f$ the heater voltage is reduced by switching switch 250 to position 2 thereby applying $V_{OF}$, the heater operating voltage, to the heater. As shown in FIG. 5*a*, $V_{IF} > V_{OF}$. Switch 250 remains in position 2 so long as the tube is in operation, but is returned to position 1 after the tube is switched off by switch 240.

Switch 260 is a triple pole double throw switch controlling the voltages to the cathode 100 and grid 270. Switch 260 is also initially in position 1 providing the direct heating voltage $V_{IC}$ to the cathode (measured with respect to the support ring 120), the bombarder voltage $V_B$ to the cathode (measured with respect to the heater) and voltage $V_{IG}$ to the grid. As described above, during the warm-up cycle the cathode is maintained at a positive potential $V_B$ in respect to the heater and the grid is maintained at a negative potential in respect to the cathode. At $t=t_1$ switch 260 is moved to position 2 thereby applying the operating cathode voltage $V_{OC}$ to the entire cathode and applying operating voltage $V_{OG}$ to the grid. Switch 260 is then also kept in position 2 so long as the tube is in operation and is returned to position 1 when the tube is switched off by switch 240.

While FIG. 6 and the related description disclose only the basic aspects of the switching circuits for practicing the present invention, it will readily be understood that well known means, such as solid state automatic sequencing circuits, may be added to enhance the operation of the switching circuitry. Likewise, the bombarder voltage $V_B$ may be maintained by appropriately switching the heater voltage rather than the cathode voltage as depicted.

The above description is of a preferred embodiment of the present invention and it should be understood that the invention is not limited to the specific form shown. Modifications may be made in the specific design and arrangement of elements without departing from the spirit of the invention as expressed in the appended claims.

What is claimed is:

1. A method of rapidly heating a thermionic vacuum tube cathode, comprising the steps of:

flowing electrical current through said cathode, thereby directly releasing thermal energy within the body of said cathode;

radiating thermal energy from a heater in proximity to said cathode, said heater being adapted to heat more rapidly than said cathode and to emit electrons when at its operating temperature;

bombarding said cathode with electrons emitted from said heater by applying a potential to said cathode which is positive with respect to said heater, thereby causing electrons released from said heater to accelerate toward and bombard said cathode.

2. A method of rapidly heating a thermionic vacuum tube cathode, as in claim 1, further comprising the step of stopping the flow of electrical current through said cathode prior to placing said vacuum tube in operation.

3. A method of rapidly heating a thermionic vacuum tube cathode, as in claim 1, further comprising the step of stopping bombardment of said cathode by electrons emitted from said heater prior to placing said tube in operation.

4. A quick-start thermionic cathode assembly for use in a vacuum tube, comprising:

a cathode body having internal electrical resistance, two electrodes, and means for flowing electrical current through the body of said cathode between said electrodes, thereby causing the release of thermal energy within the body of said cathode, a heater placed in proximity to said cathode, said heater being adapted to emit electrons when heated to its operating temperature;

means for maintaining said cathode at a positive potential with respect to said heater, thereby causing electrons released from said heater to accelerate toward and bombard said cathode.

5. A quick-start thermionic cathode assembly for use in a vacuum tube as in claim 4, further comprising switching means to disconnect said means for flowing electrical current through said cathode prior to placing said tube in operation, thereby stopping the direct heating of said cathode.

6. A quick-start thermionic cathode assembly for use in a vacuum tube as in claim 4, further comprising switching means to disconnect said potential difference between said cathode and said heater prior to placing said tube in operation, thereby stopping said electron bombardment.

7. A quick-start thermionic cathode assembly for use in a vacuum tube as in claim 4, wherein said heater is coated with electron emissive material.

8. A quick-start thermionic cathode assembly for use in a vacuum tube as in claim 4, further comprising means to apply a voltage to said heater during the initial period of cathode heating which is substantially greater than the voltage applied to said heater during normal operation of said tube.

9. A quick-start thermionic cathode assembly for use in a vacuum tube as in claim 4, wherein said cathode body is formed in the shape of a concave circular button.

10. A quick-start thermionic cathode assembly for use in a vacuum tube, comprising:

a cathode body formed in the shape of a concave circular button, having internal electrical resistance, two electrodes, and means for flowing electrical current through the body of said cathode between said electrodes, thereby causing the release of thermal energy within the body of said cathode, a heater placed in proximity of said cathode, said heater being adapted to emit electrons when heated to its operating temperature, means for maintaining said cathode at a positive potential with respect to said heater, thereby causing electrons released from said heater to accelerate towards and bombard said cathode, wherein one of said electrodes is connected to the center of said cathode button and the other of said electrodes is connected to the periphery of said cathode button.

11. A quick-start thermionic cathode assembly for use in a vacuum tube, comprising:

a cathode body formed in the shape of a concave circular button, having internal electrical resistance, two electrodes, and means for flowing electrical current through the body of said cathode between said electrodes, thereby causing the release of thermal energy within the body of said cathode, a heater placed in proximity to said cathode, said heater being adapted to emit electrons when heated to its operating temperature, means for maintaining said cathode at a positive potential with respect to said heater, thereby causing electrons released from said heater to accelerate towards and bombard said cathode, and means for evenly distributing the current flowing between said electrodes within said cathode button and for causing said current to flow in a path which is substantially longer than the distance between the electrodes.

12. A quick-start thermionic cathode assembly for use in a vacuum tube as in claim 11, wherein said means for evenly distributing the current flowing between said electrodes and for lengthening the path of said current flow comprises at least one thermally conductive, electrically insulative member incorporated in said cathode button.

13. A quick-start thermionic cathode assembly for use in a vacuum tube as in claim 12, wherein each said thermally conductive, electrically insulative member is made of anisotropic pyrolytic boron nitride.

14. A quick-start thermionic cathode assembly for use in a vacuum tube, comprising:

a circular concave cathode button having two electrodes and means for flowing electrical current evenly through said cathode button between said electrodes, thereby directly heating said cathode button, a heater placed in proximity to said cathode button, said heater being adapted to heat more rapidly than said cathode button and to emit electrons when heated to its operating temperature, means for applying a potential to said cathode button which is positive with respect to said heater, thereby causing electrons emitted from said heater when said heater is at its operating temperature to accelerate towards and bombard said cathode button, means for switching off the flow of current between said electrodes of said cathode button, and the potential difference between said cathode button and said heater, whereby said direct heating and electron bombardment of said cathode button can be discontinued before said vacuum tube is placed in operation.

15. A quick-start thermionic cathode assembly for use in a vacuum tube, wherein said heater comprises a coating of electron emissive material.

16. A quick-start thermionic cathode assembly for use in a vacuum tube, comprising:

a circular concave cathode button having two electrodes and means for flowing electrical current evenly through said cathode button between said electrodes, thereby directly heating said cathode button, a heater comprising a coating of electron emissive material placed in proximity to said cathode button, said heater being adapted to heat more rapidly than said cathode button and to emit electrons when heated to its operating temperature, means for applying a potential to said cathode button which is positive with respect to said heater, thereby causing electrons emitted from said heater when said heater is at its operating temperature to accelerate towards and bombard said cathode button, means for switching off the flow of current between said electrodes of said cathode button, and the potential difference between said cathode button and said heater, whereby said direct heating and bombardment of said cathode button can be discontinued before said vacuum tube is placed in operation, wherein one of said electrodes is connected to the center of said cathode button, and the other of said electrodes os connected to the periphery of said cathode button.

17. A quick-start thermionic cathode assembly for use in a vacuum tube, comprising:

a circular concave cathode button having two electrodes and means for flowing electrical current evenly through said cathode button between said electrodes, thereby directly heating said cathode button, a heater placed in proximity to said cathode button, said heater being adapted to heat more rapidly than said cathode button and to emit electrons when heated to its operating temperature, means for applying a potential to said cathode button which is positive with respect to said heater, thereby causing electrons emitted from said heater when said heater is at its operating temperature to accelerate towards and bombard said cathode button, means for switching off the flow of current between said electrodes of said cathode button, and the potential difference between said cathode button and said heater, whereby said direct heating and bombardment of said cathode button can be discontinued before said vacuum tube is placed in operation, wherein said means for evenly flowing electrical current through said cathode button between said electrodes comprises at least one thermally conductive, electrically insulative member incorporated within said cathode button, said member constraining said current to flow in at least one serpentine path, said path being substantially longer than the distance between the electrodes.

18. A quick-start thermionic cathode assembly for use in a vacuum tube as in claim 17, wherein said thermally conductive, electrically insulative member is made of anisotropic pyrolytic boron nitride.

19. A quick-start thermionic cathode assembly for use in a vacuum tube, comprising:

a circular concave cathode button having two electrodes and means for flowing electrical current evenly through said cathode button between said electrodes, thereby directly heating said cathode button, a heater placed in proximity to said cathode button, said heater being adapted to heat more rapidly than said cathode button and to emit electrons when heated to its operating temperature, means for applying a potential to said cathode button which is positive with respect to said heater, thereby causing electrons emitted from said heater when said heater is at its operating temperature to accelerate towards and bombard said cathode button, means for switching off the flow of current between said electrodes of said cathode button, and the potential difference between said cathode button and said heater, whereby said direct heating and bombardment of said cathode button can be discontinued before said vacuum tube is placed in operation, and means to apply a voltage a voltage to said heater during the initial period of cathode heating which is substantially greater than the voltage applied to said heater during normal operation of said tube.

20. A directly heated cathode assembly, comprising:

a cathode button having a concave surface, two electrodes positioned on said cathode button such that the application of a voltage between said electrodes causes current to flow through the body of said cathode button thereby causing heat to be produced within the body of said cathode button, means incorporated within said cathode button for evenly distributing the current flow between said electrodes and for causing said current to travel in a path substantially greater in length than the distance between said electrodes.

21. A directly heated cathode assembly, comprising:

a cathode button having a concave surface, two electrodes positioned on said cathode button such that the application of a voltage between said electrodes causes current to flow through the body of said cathode button causing heat to be produced within the body of said cathode button, means incorporated within said cathode button for evenly distributing the current flow between said electrodes and for causing said current to travel in a path substantially greater in length than the distance between said electrodes, wherein said means for evenly distributing said current and for substantially lengthening said current path comprises at least one thermally conductive, electrically insulative member incorporated into the body of said cathode button in such a fashion as to constrain said current flow to at least one serpentine path between said electrodes.

22. A directly heated cathode button as in claim 21, wherein each said thermally conductive, electrically insulative member is made of anisotropic pyrolytic boron nitride.

23. A directly heated cathode button as in claim 21, wherein each said serpentine path causes said current to reverse direction a plurality of times, thereby tending to minimize the magnetic affects of said current flow.

24. A directly heated cathode button as in claim 21, wherein one of said electrodes is connected to the center of said cathode button and the other of said electrodes is connected to the periphery of said cathode button.

25. A directly heated cathode button as in claim 21, wherein said cathode button comprises a tungsten matrix impregnated with electron emissive material.

26. A quick-start thermionic cathode assembly for use in a vacuum tube comprising:

a cathode having two electrodes and means for flowing electrical current evenly through said cathode between said electrodes, thereby directly heating said cathode, a heater placed in proximity to said cathode, said heater being adapted to heat more rapidly then said cathode and to emit electrons when heated to its operating temperature, means for applying a potential to said cathode which is positive with respect to said heater, thereby causing electrons emitted from said heater when said heater is at its operating temperature to accelerate towards and bombard said cathode, means for switching off the flow of current between said electrodes of said cathode, and the potential difference between said cathode button and said heater, whereby said direct heating and bombardment of said cathode can be discontinued befored said vacuum tube is placed in operation, means for constraining the path of electrical current between said electrodes so that said path is longer than the distance between said electrodes.

27. A directly heated cathode assembly, comprising a cathode button, two electrodes positioned on said cathode button such that the application of a voltage between said electrodes causes current to flow through the body of said cathode button causing heat to be produced within the body of said cathode button, means incorporated within said cathode button for evenly distributing the current flow between said electrodes and for causing said current to travel in a path substnatially greater in length than the distance between said electrodes, wherein said means for evenly distributing said current and for substantially lengthening said current path comprises at least one thermally conductive, electrically insulative member incorporated into the body of said cathode button in such a fashion as to constrain said current flow to at least one serpentine path between said electrodes.

28. A method of rapidly heating a thermionic vacuum tube cathode, as in claim 1, further comprising the steps of initially applying a voltage to said heater substantially in excess of its normal operating voltage and thereafter reducing the voltage applied to said heater to its normal operating voltage.

* * * * *